US007380559B2

(12) United States Patent
Son et al.

(10) Patent No.: US 7,380,559 B2
(45) Date of Patent: Jun. 3, 2008

(54) DISHWASHER

(75) Inventors: Wang Seok Son, Seoul (KR); Ki Nam Park, Suwon-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 449 days.

(21) Appl. No.: 10/921,952

(22) Filed: Aug. 20, 2004

(65) Prior Publication Data

US 2005/0126609 A1 Jun. 16, 2005

(30) Foreign Application Priority Data

Dec. 16, 2003 (KR) ..... 10-2003-0092195

(51) Int. Cl.
*B08B 3/02* (2006.01)

(52) U.S. Cl. ..... 134/56 D; 134/57 D; 134/200; 134/201; 362/430; 362/457

(58) Field of Classification Search ..... 134/56 D, 134/57 D, 201, 200; 362/382, 430, 457
See application file for complete search history.

(56) References Cited

U.S. PATENT DOCUMENTS 2,010,618 A * 8/1935 Worth et al. ..... 362/94
2,577,541 A * 12/1951 Resek et al. ..... 362/94
2,656,451 A 10/1953 Rick
2,664,902 A * 1/1954 Campion ..... 134/175
2,683,258 A * 7/1954 Churchill ..... 439/548
2,692,790 A * 10/1954 Tharrington ..... 296/3
2,731,613 A * 1/1956 Heller ..... 439/556
2,734,992 A 2/1956 Elliott et al.
2,737,573 A * 3/1956 Olthuis ..... 362/91
2,998,512 A * 8/1961 Duchene et al. ..... 362/364
3,047,829 A * 7/1962 Mouat ..... 362/549
3,378,812 A * 4/1968 Fitzgerald ..... 439/546

(Continued)

FOREIGN PATENT DOCUMENTS

AU 612 061 3/1990

(Continued)

OTHER PUBLICATIONS

European Search Report, mailed May 30, 2007 and issued in corresponding European Patent Application No. 04255217.4-2314.

(Continued)

*Primary Examiner*—Frankie L Stinson
(74) *Attorney, Agent, or Firm*—Staas & Halsey LLP

(57) ABSTRACT

A dishwasher equipped with a lamp assembly. The lamp assembly includes a lamp bracket, a lamp cover and a plurality of fastening projections. The lamp bracket is fitted into an opening to accommodate the lamp from an outside of the inner casing. The lamp cover is detachably fitted into the lamp bracket from an inside of the inner casing. The plurality of fastening projections fit the lamp bracket into the opening. The fastening projections are projected from a front rim of the lamp bracket to be elastically deformable, and have gaps each corresponding to a thickness of the inner casing. The inner casing includes movement prevention notches extended outward from the opening at locations where the fastening projections will be interlocked.

19 Claims, 4 Drawing Sheets

U.S. PATENT DOCUMENTS

| | | | | | |
|---|---|---|---|---|---|
| 3,619,592 | A | * | 11/1971 | Lamb, Jr. | 362/91 |
| 3,621,232 | A | * | 11/1971 | Hough et al. | 362/548 |
| 3,626,359 | A | * | 12/1971 | De Lano | 439/546 |
| 3,737,837 | A | * | 6/1973 | Whitehead | 439/546 |
| 3,877,460 | A | * | 4/1975 | Lotz et al. | 126/200 |
| 3,915,180 | A | * | 10/1975 | Jacobs | 134/58 D |
| 4,326,243 | A | * | 4/1982 | Pistor et al. | 362/368 |
| D323,134 | S | * | 1/1992 | Lechner | D12/96 |
| 5,836,669 | A | * | 11/1998 | Hed | 362/92 |

FOREIGN PATENT DOCUMENTS

| | | | |
|---|---|---|---|
| DE | 29 37 499 | * | 5/1980 |
| DE | 31 23 314 | * | 12/1982 |
| DE | 36 06 421 | * | 4/1987 |
| DE | 36 43 307 | * | 6/1988 |
| DE | 40 02 497 | * | 8/1991 |
| DE | 43 04 523 | * | 8/1994 |
| DE | 44 26 074 | | 10/1995 |
| DE | 295 11 978 | * | 10/1996 |
| DE | 1999 03 918 | * | 8/2000 |
| GB | 2 172 389 | * | 9/1986 |
| JP | 8-248897 | | 9/1996 |
| JP | 9-117589 | | 5/1997 |
| JP | 10-205777 | | 8/1998 |
| JP | 11-342098 | | 12/1999 |
| JP | 2000-41932 | | 2/2000 |
| JP | 2000-167289 | * | 6/2000 |
| JP | 2000-316782 | | 11/2000 |
| JP | 2003-336963 | | 11/2003 |
| KR | 1994-3528 | | 3/1994 |

OTHER PUBLICATIONS

Japanese Patent Office Action, mailed Mar. 20, 2007 and issued in corresponding Japanese Patent Application No. 2004-303572.

* cited by examiner

DISHWASHER

CROSS-REFERENCE TO RELATED APPLICATIONS

This application claims the benefit of Korean Patent Application No. 2003-92195, filed Dec. 16, 2003 in the Korean Intellectual Property Office, the disclosure of which is incorporated herein by reference.

BACKGROUND OF THE INVENTION

1. Field of the Invention

The present invention relates, in general, to dishwashers and, more particularly, to a dishwasher equipped with a lamp assembly, which is constructed to allow a lamp to be conveniently and rapidly replaced by a new one.

2. Description of the Related Art

Generally, a dishwasher is an appliance which includes a box shaped cabinet having an opened front part and which is configured to have a cavity to wash dishes therein, and a door configured to selectively open and close the opened front part of the cabinet, to automatically washes dishes placed in the cavity.

Typically, upper and lower dish racks are installed in upper and lower portions of the cavity so that dishes are stably seated thereon to be washed by sprayed water. A water collecting container to collect wash water, a wash water circulating pump to circulate the wash water, and a drain pump to drain the wash water are each installed in the lower portion of the cavity.

Furthermore, a plurality of spray nozzles are placed in the cavity to allow dishes to be washed by spraying water, which flows through spray ducts connected to the wash water circulating pump, onto the upper and lower dish racks. An outlet of the drain pump is connected to a drain pipe, so that wash water may be drained to an outside of the dishwasher through the drain pipe after washing has been completed.

Therefore, when the wash water circulating pump is operated, water supplied to the spray nozzles through the spray ducts is sprayed in various directions, so that dishes seated on the upper and lower dish racks are washed. Thereafter, when the washing has been completed and the drain pump is operated, the wash water is drained to the outside of the dishwasher.

Because the dishwasher is generally placed below a sink in a kitchen, an inside of the cavity of the dishwasher is dark and is not sufficiently seen when the washing has been completed and the door is opened. Therefore, it is inconvenient to remove washed dishes from the dishwasher, and there is a risk that the dishes may drop and be damaged during the removing.

Accordingly, to illuminate the cavity, a lamp should be installed on an inner plate of a cabinet defining the cavity. However, the inner plate of the cabinet comprises a thin plate, so that installing a lamp assembly, which is equipped with a lamp on the inner plate is difficult. Moreover, even though the lamp assembly, which is equipped with the lamp, is installed in the cavity, providing the lamp assembly with a structure that allows the lamp to be replaced by a new lamp is difficult.

SUMMARY OF THE INVENTION

Additional aspects and/or advantages of the invention will be set forth in part in the description which follows and, in part, will be obvious from the description, or may be learned by practice of the invention.

Accordingly, an aspect of the present invention to provides a dishwasher equipped with a lamp assembly, in which a lamp to illuminate a cavity may be conveniently and rapidly replaced by a new one.

Additional and/or other aspects and advantages of the invention will be set forth in part in the description which follows and, in part, will be obvious from the description, or may be learned by practice of the invention.

The above and/or other aspects are achieved by providing a dishwasher, including an inner casing having a cavity therein in which dishes are washed, and a lamp assembly fitted into an opening formed in the inner casing to illuminate the cavity. The lamp assembly includes a lamp bracket fitted into the opening from an outside of the inner casing to accommodate a lamp, a lamp cover detachably fitted into the lamp bracket from an inside of the inner casing, and at least one fastening member configured to fit the lamp bracket into the opening.

The at least one fastening member may include a plurality of fastening projections projected from a front rim of the lamp bracket to be elastically deformable and which are provided with gaps, each at which corresponds to a thickness of the inner casing. The fastening projections are interlocked with the inner casing after the front rim is located close to the opening to fit the lamp bracket into the inner casing.

In an aspect of the invention, the inner casing includes one or more movement prevention notches extended outward from the opening at locations where the fastening projections will be interlocked to prevent the fastening projections from moving clockwise and counterclockwise.

In an aspect of the invention, the lamp bracket is formed in a rough ring shape, and the opening may be formed in a circular shape to correspond to the lamp bracket, so that the fastening projections are interlocked with the movement prevention notches after the front rim of the lamp bracket is located close to the opening.

In an aspect of the invention, the lamp bracket includes a rib formed between opposite portions of the lamp bracket. The rib has a socket mounted on a center portion thereof to allow the lamp to be detachably mounted to the socket.

In an aspect of the invention, the lamp cover includes a flange perpendicularly extended from an outer circumference thereof, so that the flange is located close to the opening while an inner circumference of the lamp cover is brought into contact with an outer circumference of the lamp bracket.

In an aspect of the invention, the lamp assembly includes a packing interposed between the flange and the inner casing to prevent water from leaking through the opening.

In an aspect of the invention, the lamp bracket includes a plurality of first locking projections formed on an inner circumference thereof in a circumferential direction, and the lamp cover may include a plurality of second locking projections formed on the outer circumference thereof and configured to have widths increasing in a circumferential direction, so that the second locking projections are interlocked with or released from the first locking projections when the lamp cover is fitted into the lamp bracket and then turned to allow the lamp cover to be attached to or detached from the lamp bracket.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
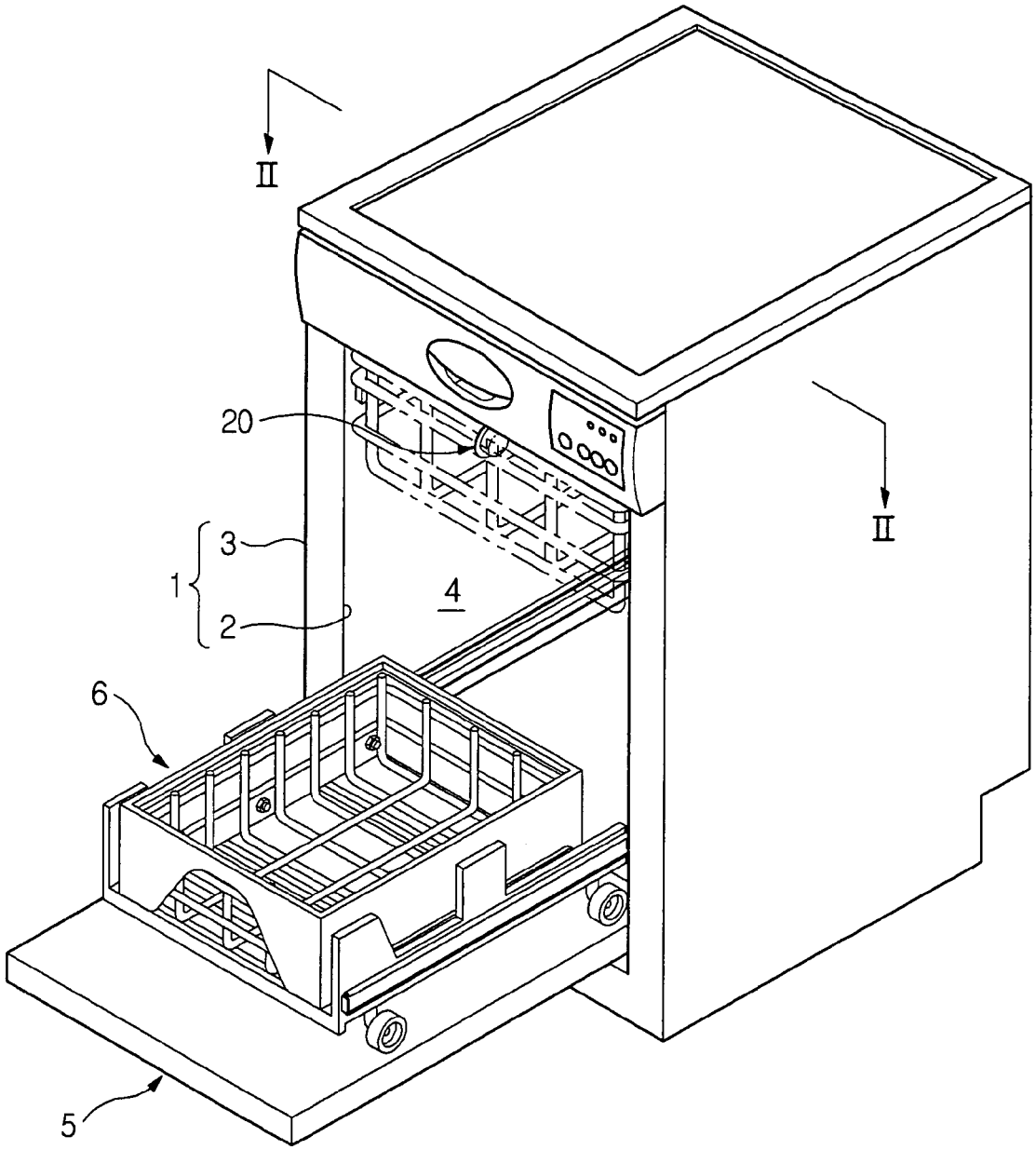
FIG. 1 is a perspective view schematically showing an appearance of a dishwasher with a door thereof being opened, according to the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 2:
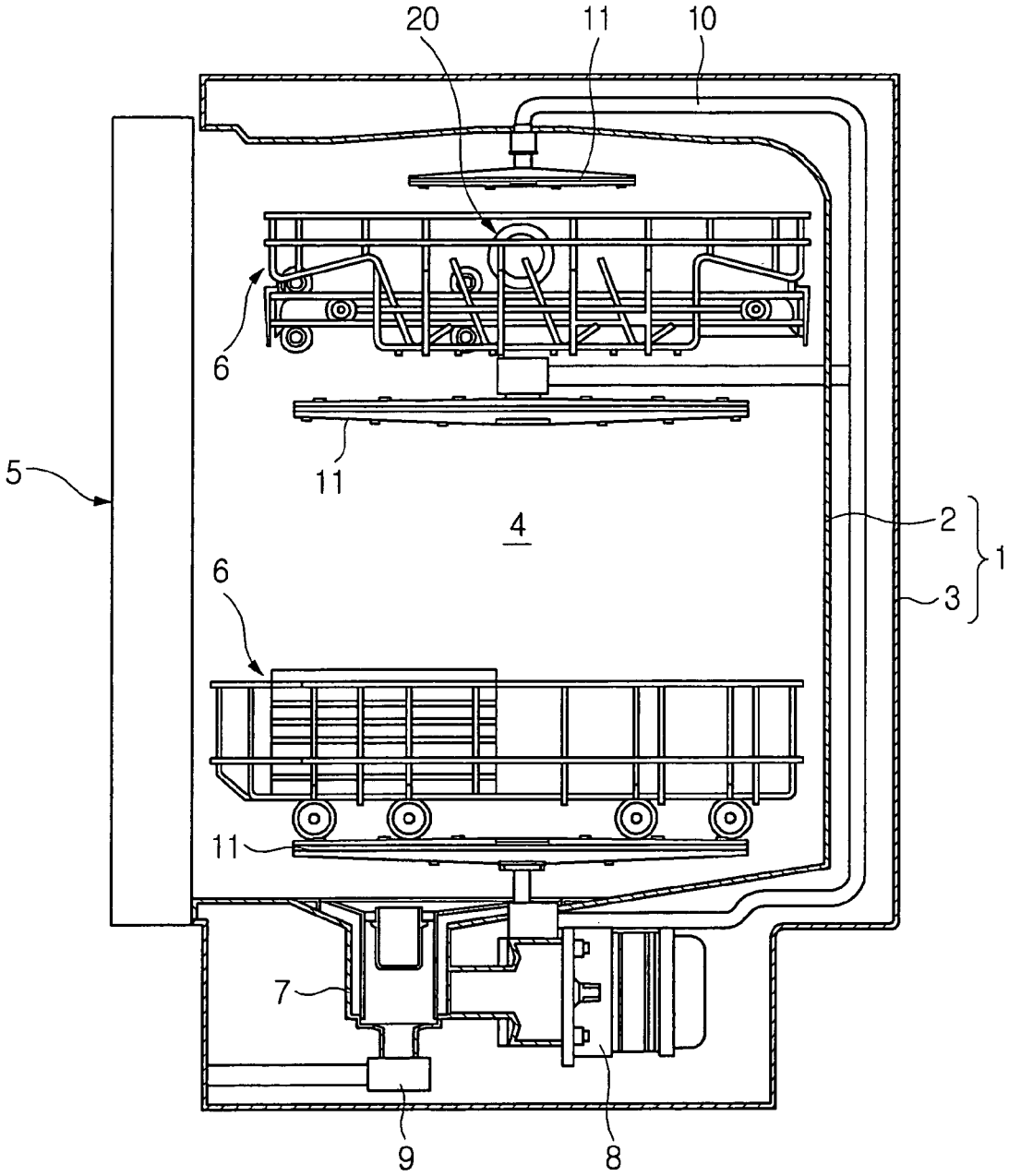
FIG. 2 is a sectional view taken along line II-II of FIG. 1.

FIGS. 1 and 2 are views schematically showing a structure of a dishwasher equipped with a lamp assembly, according to the present invention. As shown in FIGS. 1 and 2, the dishwasher of the present invention includes a body 1 formed in a box shape having an opened front part, and a door 5 to selectively open and close the opened front part of the body 1 thus defining the shape of the dishwasher.

The body 1 includes an inner casing 2 forming a space or cavity 4 to allow dishes to be washed therein, and an outer casing 3 surrounding the inner casing 2.

At least one dish rack is placed in the inner casing 2 to be movable in forward and rearward directions. A water collecting container 7, a wash water circulating pump 8 and a drain pump 9 are placed below the cavity 4.

The wash water circulating pump 8 pumps water which is collected in the water collecting container 7, to a plurality of spray nozzles 11 through a connection pipe 10 to allow the water to be sprayed from the spray nozzles 11 and to wash dishes.

A lamp assembly 20 is included on a portion of the inner casing 2, to illuminate a space inside of the inner casing 2, e.g. the cavity 4, and to allow for dishes to be placed in and taken out of the cavity 4 when the door 5 is opened before and after washing.

A construction and assembly structure of the lamp assembly 20 are described with reference to FIGS. 3 and 4.

Figure 3:
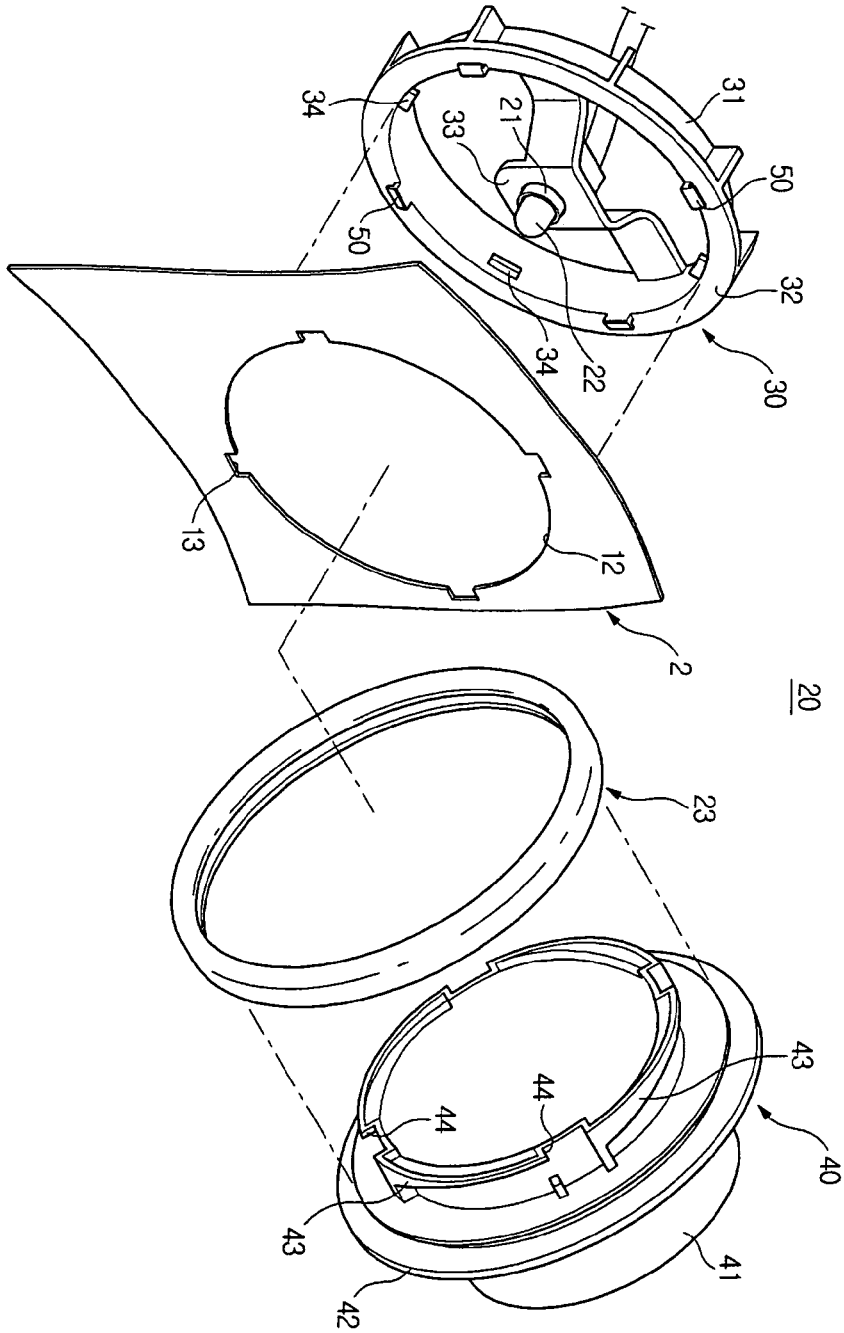
FIG. 3 is an exploded perspective view of a lamp assembly of FIG. 2.
Figure 4:
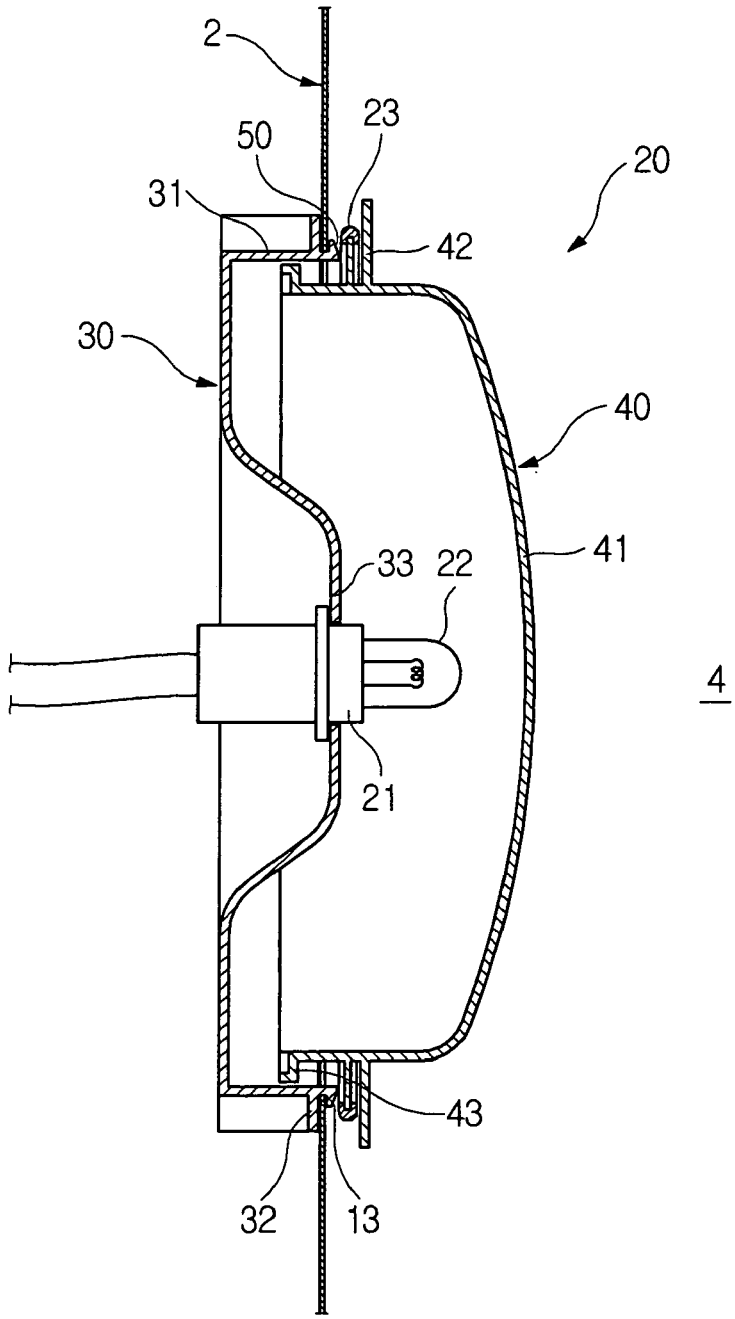
FIG. 4 is a sectional view of the lamp assembly fitted into an inner casing of the dishwasher.

FIG. 3 is an exploded perspective view of the lamp assembly 20, and FIG. 4 is a sectional view of the lamp assembly 20 after the lamp assembly 20 is fitted into the inner casing 2 of the dishwasher. As shown in FIGS. 3 and 4, an opening 12, into which the lamp assembly 20 is fitted into, is included in the inner casing 2. The lamp assembly 20 is therefore able to illuminate the space inside of the inner casing 2.

The lamp assembly 20 includes a lamp bracket 30 to accommodate a lamp 22 and which is fitted into the opening 12 from an outside of the inner casing 2. A lamp cover 40 is detachably fitted into the lamp bracket 30 from the inside of the inner casing 2 to prevent water from being splashed onto the lamp bracket 30 and to project light which is emitted from the lamp 22 onto the inner casing 2.

The lamp bracket 30 includes a substantially rough ring shaped body 31 having a front rim 32 to extend outward from a front of the body 31 by a certain length, and a rib 33 located in the body 31 to connect opposite portions of the body 31. A socket 21 to hold the lamp 22 is formed on a center portion of the rib 33 to allow the lamp 22 to be easily attached to and detached from the socket 21.

A plurality of first locking projections 34 are formed on an inner circumference of the body 31 at regular intervals to allow the lamp cover 40 to be detachably fitted into the lamp bracket 30. A plurality of fastening projections 50, which function as fastening members to fit the lamp bracket 30 into the opening 12 of the inner casing 2, are formed on the front rim 32 at regular intervals.

The fastening projections 50 are projected from an inner circumference of the front rim 32 having an inside diameter which is approximately equal to a diameter of the opening 12 which has a circular shape. The fastening projections 50 extend toward an outer circumference of the front rim 32 to form gaps, each gap corresponding to a thickness of the inner casing 2, between the fastening projections 50 and the front rim 32. That is, the fastening projections 50 are projected from the inner circumference of the front rim 32 to be elastically deformable and to be integrated with the front rim 32, so that each of the fastening projections 50 is formed in a rough "L" shape.

Further, movement prevention notches 13 are formed around the opening 12 at regular intervals which are equal to the intervals of the fastening projections 50 to prevent the lamp bracket 30 from moving even though a user may grip and turn the lamp bracket 30 after the lamp bracket 30 is fitted into the opening 12 using the fastening projections 50.

In an embodiment of the invention, a length by which each of the movement prevention notches 13 is extended outward from the opening 12 is to be slightly less than a length by which each of the fastening projections 50 is extended from the inner circumference of the front rim 32 to the outer circumference of the front rim 32, so that the fastening projections 50 are interlocked with the inner casing 2 at locations of the movement prevention notches 13.

Therefore, when the front rim 32 of the lamp bracket 30 is located close to the opening 12, while the fastening projections 50 are aligned with the respective movement prevention notches 13, the fastening projections 50 pass through the movement prevention notches 13 while being elastically deformed, and are then interlocked with the inner casing 2 after recovering to their original shapes. As a result, the lamp bracket 30 is fitted into the opening 12. In this state, the lamp bracket 30 is caught by the movement prevention notches 13 and not moved further.

The lamp cover 40, made of a light transmitting material includes a body 41 having a rough cylinder shape with an opened rear part facing the lamp bracket 30, and a flange 42 which is perpendicularly extended from an outer circumference of the body 41.

A plurality of second locking projections 43, having positions which correspond to positions at the plurality of the first locking projections 34 which are formed on the inner circumference of the body 31 of the lamp bracket 30, are formed on an outer circumference of a portion of the body 41 of the lamp cover 40 between an opened end of the body 41 and the flange 42.

The second locking projections 43 are longer in a circumferential direction than the first locking projections 34, and have widths which gradually increase in a direction in which the lamp cover 40 is fitted into the lamp bracket 30.

Further, a ring-shaped packing 23 made of a material, such as a rubber, is interposed between the inner casing 2 and the flange 42 of the lamp cover 40 to prevent water from leaking through a gap between the opening 12 of the inner casing 2 and the lamp cover 40.

Therefore, when the lamp cover 40 is fitted into the lamp bracket 30, which is fitted into the opening 12, and then is turned in a direction in which the widths of the second locking projections 43 increase while notches 44, formed between the second locking projections 43, are aligned with the first locking projections 34 of the lamp bracket 30, portions of the second locking projections 43 having greatest widths are interlocked with the first locking projections 34. In this state, the packing 23 is brought into tight contact with the inner casing 2 by the flange 42. As a result, formation of a gap between the opening 12 of the inner casing 2 and the lamp cover 40 is prevented.

If the lamp cover 40 is turned in a direction which is reverse to the above turning direction to replace the lamp 22 mounted to the lamp bracket 30 by a new one after the lamp cover 40 is fitted into the lamp bracket 30, the second locking projections 43 interlocked with the first locking projections 34 are released from the first locking projections 34. As a result, the notches 44 of the lamp cover 40 aligned with the first locking projections 34 are released, and then the lamp cover 40 is detached from the lamp bracket 30.

In this way, the lamp bracket 30 is maintained in a fitted position in the inner casing 2 by the fastening projections 50 while the lamp cover 40 is detached from the lamp bracket 30, so that the lamp 22 may be removed from the socket 21.

As is apparent from the above description, the present invention provides a dishwasher, in which a lamp bracket is fitted into an inner casing and a lamp cover is fitted into the lamp bracket to be easily detached therefrom, so that a lamp may be conveniently and rapidly replaced by a new one to improve the convenience when using the dishwasher.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A dishwasher, including an inner casing having an opening and a cavity therein in which dishes are washed, having a lamp assembly fitted into the opening formed in the inner casing to illuminate the cavity, the lamp assembly comprising:

a lamp bracket fitted into the opening from an outside of the inner casing to accommodate a lamp;

a lamp cover, detachably fitted into the lamp bracket from an inside of the inner casing; and at least one fastening member configured to fit the lamp bracket into the opening, comprising a plurality of fastening projections projected from a front rim of the lamp bracket to receive the inner casing between the projections and the front rims, the lamp cover comprising a plurality of locking projections having widths increasing in a circumferential direction, to interlock with or be released from the lamp bracket based upon a position of the lamp bracket.

2. A dishwasher, including an inner casing having an opening and a cavity therein in which dishes are washed, having a lamp assembly fitted into the opening formed in the inner casing to illuminate the cavity, the lamp assembly comprising:

a lamp bracket fitted into the opening from an outside of the inner casing to accommodate a lamp;

a lamp cover, detachably fitted into the lamp bracket from an inside of the inner casing; and at least one fastening member configured to fit the lamp bracket into the opening, wherein the at least one fastening member comprises:

a plurality of fastening projections projected from a front rim of the lamp bracket to be elastically deformable and including gaps to a thickness of the inner casing, wherein the fastening projections are interlocked with the inner casing after the front rim is located close to the opening to fit the lamp bracket into the inner casing, the lamp cover comprising a plurality of locking projections having widths increasing in a circumferential direction, to interlock with or be released from the lamp bracket based upon a position of the lamp bracket.

3. The dishwasher according to claim 2, wherein the inner casing comprises one or more movement prevention notches extended outward from the opening at locations where the fastening projections will be interlocked to prevent the fastening projections from moving.

4. The dishwasher according to claim 3, wherein the lamp bracket is rough ring shaped, and the opening is circular to correspond to the shape of the lamp bracket to allow the fastening projections to be interlocked with the movement prevention notches after the front rim of the lamp bracket is located close to the opening.

5. The dishwasher according to claim 3, wherein the lamp bracket comprises a rib between opposite portions of the lamp bracket, wherein the rib has a socket on a center portion thereof to allow the lamp to be detachably mounted to the socket.

6. The dishwasher according to claim 3, wherein the lamp cover comprises a flange which is perpendicularly extended from an outer circumference thereof, to guide the flange to be close to the opening while an inner circumference of the lamp cover is brought into contact with an outer circumference of the lamp bracket.

7. The dishwasher according to claim 6, wherein the lamp assembly comprises a packing between the flange and the inner casing to prevent water from leaking through the opening.

8. A dishwasher, including an inner casing having an opening and a cavity therein in which dishes are washed, having a lamp assembly fitted into the opening formed in the inner casing to illuminate the cavity, the lamp assembly comprising:

a lamp bracket fitted into the opening from an outside of the inner casing to accommodate a lamp;

a lamp cover, detachably fitted into the lamp bracket from an inside of the inner casing; and at least one fastening member configured to fit the lamp bracket into the opening, wherein the at least one fastening member comprises:

a plurality of fastening projections projected from a front rim of the lamp bracket to be elastically deformable and including gaps to a thickness of the inner casing, wherein the fastening projections are interlocked with the inner casing after the front rim is located close to the opening to fit the lamp bracket into the inner casing, wherein the inner casing comprises one or more movement prevention notches extended outward from the opening at locations where the fastening projections will be interlocked to prevent the fastening projections from moving, wherein the lamp cover comprises a flange which is perpendicularly extended from an outer circumference thereof, to guide the flange to be close to the opening while an inner circumference of the lamp cover is brought into contact with an outer circumference of the lamp bracket wherein the lamp bracket comprises a plurality of first locking projections on an inner circumference thereof in a circumferential direction, and the lamp cover comprises a plurality of second locking projections, on the outer circumference thereof, having widths increasing in a circumferential direction, to interlock with or be released from the first locking projections when the lamp cover is fitted into the lamp bracket and then turned.

9. A lamp assembly of a dishwasher, including an inner casing having an opening comprising notches and a dishwashing cavity therein, comprising:

a lamp bracket received in the notches of the opening to accommodate a lamp, the notches preventing rotation of the lamp bracket relative to the inner casing;

a lamp cover, detachably fit into the lamp bracket from the dishwashing cavity; and at least one fastening member configured to fit the lamp bracket into the opening, wherein the bracket includes a substantially ring shaped body and comprises:

a front of the bracket body;

a front rim to extend from the front of the bracket body, having an inner circumference which is substantially equal to a diameter of the opening and an outer circumference which is larger than the inner circumference;

a rib in the bracket body to connect opposite portions of the bracket body;

a socket to hold the lamp on a center portion of the rib;

a plurality of first locking projections on an inner circumference of the bracket body; and a plurality of fastening projections, respectively including a base and a tip, to fasten the lamp bracket into the opening.

10. The lamp assembly according to claim 9, wherein the fastening projections are L-shaped, elastically deformable, and respectively project from the inner circumference of the front rim toward the outer circumference of the front rim to form gaps between the front rim and the tips, which correspond in length to a width of the inner casing.

11. A lamp assembly of a dishwasher, including an inner casing having an opening and a dishwashing cavity therein, comprising:

a lamp bracket in the opening to accommodate a lamp;

a lamp cover, detachably fit into the lamp bracket from the dishwashing cavity;

at least one fastening member configured to fit the lamp bracket into the opening wherein the bracket includes a substantially ring shaped body and comprises:

a front of the bracket body, a front rim to extend from the front of the bracket body, having an inner circumference which is substantially equal to a diameter of the opening and an outer circumference which is larger than the inner circumference, a rib in the bracket body to connect opposite portions of the bracket body, a socket to hold the lamp on a center portion of the rib, a plurality of first locking projections on an inner circumference of the bracket body, and a plurality of fastening projections, respectively including a base and a tip, to fasten the lamp bracket into the opening, wherein the fastening projections are L-shaped, elastically deformable, and respectively project from the inner circumference of the front rim toward the outer circumference of the front rim to form gaps between the front rim and the tips, which correspond in length to a width of the inner casing; and movement prevention notches formed around the opening at positions corresponding to positions of the fastening projections to prevent the lamp bracket from moving.

12. The lamp assembly according to claim 11, wherein a length that the movement prevention notches extend outward from the opening is shorter than a length by which each of the fastening projections extends from the elbow of the L-shape to an end of the tip.

13. The lamp assembly according to claim 12, wherein when the front rim is close to the opening such that the fastening projections are aligned with the respective movement prevention notches, the fastening projections pass through the movement prevention notches, elastically deform, and interlock with the inner casing upon recovery of an original shape.

14. The lamp assembly according to claim 13, wherein the lamp cover is made of a light transmitting material and comprises:

a body having a substantially cylindrical shape, including an opened rear part to face the lamp bracket; and a flange to perpendicularly extend from an outer circumference of the body.

15. The lamp assembly according to claim 14, wherein the lamp cover further comprises second locking projections, having positions which correspond to respective positions of the first locking projections, on an outer circumference of the body of the lamp cover between the opened end of the body and the flange.

16. The lamp assembly according to claim 15, wherein the second locking projection are longer than the first locking projection in a circumferential direction and have widths which gradually increase in a direction in which the lamp cover is fit into the lamp bracket.

17. The lamp assembly according to claim 16, further comprising a substantially ring shaped packing between the inner casing and the flange to prevent water from leaking through a gap between the opening of the inner casing and the lamp cover.

18. The lamp assembly according to claim 17, wherein the substantially ring shaped packing is made of rubber.

19. The lamp assembly according to claim 17, wherein when the lamp cover is fitted into the opening and then is turned in a first direction in which the widths of the second locking projections increase, the packing is brought into tight contact with the inner casing by the flange.

* * * * *

UNITED STATES PATENT AND TRADEMARK OFFICE

CERTIFICATE OF CORRECTION

PATENT NO. : 7,380,559 B2
APPLICATION NO. : 10/921952
DATED : June 3, 2008
INVENTOR(S) : Wang Seok Son It is certified that error appears in the above-identified patent and that said Letters Patent is hereby corrected as shown below:

Column 5, Line 51, change “rims,” to --rim,--.

Column 6, Line 67, after “bracket” insert --,--.

Signed and Sealed this

Seventh Day of October, 2008

JON W. DUDAS
*Director of the United States Patent and Trademark Office*